US009862073B2

(12) United States Patent
Niblock

(10) Patent No.: US 9,862,073 B2
(45) Date of Patent: Jan. 9, 2018

(54) END EFFECTOR ADJUSTMENT SYSTEMS AND METHODS

(71) Applicant: Flow International Corporation, Kent, WA (US)

(72) Inventor: Robert Niblock, Maple Valley, WA (US)

(73) Assignee: FLOW INTERNATIONAL CORPORATION, Kent, WA (US)

( * ) Notice: Subject to any disclaimer, the term of this patent is extended or adjusted under 35 U.S.C. 154(b) by 394 days.

(21) Appl. No.: 14/470,882

(22) Filed: Aug. 27, 2014

(65) Prior Publication Data

US 2016/0059384 A1 Mar. 3, 2016

(51) Int. Cl.
*B24C 5/02* (2006.01)
*B24C 1/04* (2006.01)

(52) U.S. Cl.
CPC ..... *B24C 5/02* (2013.01); *B24C 1/045* (2013.01)

(58) Field of Classification Search
CPC ..... B24C 5/02; B24C 5/045
USPC ..... 451/5, 8–10, 75, 102; 83/53, 177
See application file for complete search history.

(56) References Cited

U.S. PATENT DOCUMENTS 4,393,728 A * 7/1983 Larson ..... B05B 15/061 248/160
4,435,902 A * 3/1984 Mercer ..... B23Q 9/0064 299/17
4,826,087 A * 5/1989 Chinery ..... B05B 13/0431 137/636
5,404,923 A 4/1995 Yamamoto et al.
5,643,058 A 7/1997 Erichsen et al.
5,836,083 A 11/1998 Sangwan
5,927,934 A 7/1999 Dadiomov
6,932,547 B2 8/2005 Hardesty et al.
6,988,434 B1 1/2006 Jiao
7,933,080 B1 4/2011 Sharrow et al.
8,516,903 B2 8/2013 Yagati et al.

FOREIGN PATENT DOCUMENTS

DE 198 10 333 A1 9/1999

* cited by examiner

*Primary Examiner* — Robert Rose
(74) *Attorney, Agent, or Firm* — Seed IP Law Group LLP

(57) ABSTRACT

Systems and related methods are provided for adjusting the position and orientation of an end effector of a multi-axis machine (e.g., a manipulable cutting head of a fluid jet cutting machine) relative to a base reference frame. Systems include an adjustable tool mount having a base structure that includes portions or regions that are selectively deformable to adjust a position and an orientation of a tool supported by the adjustable tool mount.

30 Claims, 7 Drawing Sheets

END EFFECTOR ADJUSTMENT SYSTEMS AND METHODS

BACKGROUND

Technical Field

This disclosure relates to systems and methods for adjusting the position and orientation of an end effector of a multi-axis machine, such as a manipulable cutting head of a fluid jet cutting machine.

Description of the Related Art

High-pressure fluid jets, including high-pressure abrasive waterjets, are used to cut a wide variety of materials in many different industries. Systems for generating high-pressure abrasive waterjets are currently available, such as, for example, the Mach 4™ five-axis abrasive waterjet system manufactured by Flow International Corporation, the assignee of the present invention, as well as other systems that include a cutting head assembly mounted to an articulated robotic arm. Other examples of abrasive fluid jet cutting systems are shown and described in Flow's U.S. Pat. No. 5,643,058, which is incorporated herein by reference. The terms "high-pressure fluid jet" and "jet" should be understood to incorporate all types of high-pressure fluid jets, including but not limited to, high-pressure waterjets and high-pressure abrasive waterjets. In such systems, high-pressure fluid, typically water, flows through an orifice of an orifice unit in a cutting head to form a high-pressure jet, into which abrasive particles may be combined as the jet flows through a mixing chamber and a mixing tube to form a high-pressure abrasive waterjet. The high-pressure abrasive waterjet is typically discharged from the mixing tube and directed toward a workpiece to cut the workpiece along a designated path.

Various systems are currently available to move a high-pressure fluid jet along a designated path. Such systems may commonly be referred to, for example, as three-axis and five-axis machines. Conventional three-axis machines mount the cutting head assembly in such a way that it can move along an x-y plane and perpendicularly thereto along a z-axis, namely toward and away from the workpiece. In this manner, the high-pressure fluid jet generated by the cutting head assembly is moved along the designated path in an x-y plane, and is raised and lowered relative to the workpiece, as may be desired. Conventional five-axis machines work in a similar manner but provide for movement about two additional non-parallel rotary axes. Other systems may include a cutting head assembly mounted to an articulated robotic arm, such as, for example, a six-axis robotic arm which articulates about six separate rotary axes.

Computer-aided manufacturing (CAM) processes may be used to drive or control such conventional machines along a designated path, such as by enabling two-dimensional or three-dimensional models of workpieces generated using computer-aided design (i.e., CAD models) to be used to generate code to drive the machines. For example, a CAD model may be used to generate instructions to drive the appropriate controls and motors of the machine to manipulate the machine about its translational and/or rotary axes to cut or process a workpiece as reflected in the model.

Manipulating a fluid jet about five or six axes may be particularly useful for a variety of reasons, for example, to cut a three-dimensional shape. To facilitate accurate machining of complex parts using a five-axis or six-axis machine it may be advantageous to adjust for any differences between the spatial location of a tool of the machine and an expected tool location defined by the design of the machine, which may arise from tolerance stackup, for example. The expected tool location may be dependent on a number of factors, including machine configuration. For example, in a five-axis fluid jet cutting machine having three translational axes and two non-parallel rotary axes that converge to form a machine focal point, the expected tool location may be located in line with or a selected offset distance from the machine focal point. In other machines, an expected tool location may be positioned relative to a reference frame of a terminal component or link of the machine.

In some instances, it is beneficial to align a tool of a machine with the machine's focal point. To set up or test whether a tool of the machine is aligned with the focal point or within a generally accepted tolerance range, it is known to perform manual measurements and physically adjust the alignment of the system based on such measurements, for example, by adjusting the position of the tool along various slide rails or adjustment slots that may be provided in tool mounting structures provided between the tool and the positioning system. Such adjustment systems, however, can be overly complex and bulky, which can result in increased costs and possible degradation of dynamic performance of the machine. Other systems for compensating for tool misalignment include assessing the magnitude and direction of the misalignment and compensating for them by making changes in the software (CNC code) that drives the machine motion.

BRIEF SUMMARY

Embodiments described herein provide enhanced systems and methods for adjusting the position and orientation of an end effector of a multi-axis machine, such as, for example, a manipulable cutting head of a fluid jet cutting machine, to improve system accuracy and performance.

For example, one embodiment of a cutting head assembly of a fluid jet cutting system may be summarized as including: a cutting head through which fluid passes during operation to generate a high-pressure fluid jet for processing a workpiece; and an adjustable mount for the cutting head which is manipulable in space to position and orient the cutting head relative to the workpiece, the adjustable mount having a base structure that is selectively deformable to adjust a position and an orientation of the cutting head relative to a base reference frame.

The base structure of the adjustable mount may be asymmetrically deformable at a plurality of locations to adjust an angular orientation of the cutting head with respect to at least two rotational degrees of freedom. The base structure of the adjustable mount may be asymmetrically deformable at a plurality of locations to adjust a pitch, a yaw and a roll of the cutting head. The base structure may include a plurality of resiliently compressible structures for enabling adjustment of the position and the orientation of the cutting head. Each resiliently compressible structure may include a serpentine body. The adjustable mount may include a pair of independently adjustable adjustment mechanisms for each of the resiliently compressible structures. The base structure of the adjustable mount may be configured such that differential adjustment of each pair of adjustment mechanisms causes the base structure to bend away from a neutral configuration. The base structure of the adjustable mount may be configured such that equal adjustment of each pair of adjustment mechanisms causes the base structure to extend or contract linearly along a respective orthogonal direction. The base structure of the adjustable mount may be a unitary structure that is translationally adjustable in each of a plurality of orthogonal directions and adjustably bendable in at least two primary directions. The unitary structure may be adjustably bendable in lateral, vertical and torsional directions.

One embodiment of a machine may be summarized as including: a tool for processing a workpiece; a tool positioning system for manipulating the tool in space; and an adjustable mount coupled between the tool and the tool positioning system, the adjustable mount having a base structure that is selectively deformable to adjust a position and an orientation of the tool relative to a base reference frame.

The base structure of the adjustable mount may be asymmetrically deformable at a plurality of locations to adjust an angular orientation of the tool with respect to at least two rotational degrees of freedom. The base structure of the adjustable mount may be asymmetrically deformable at a plurality of locations to adjust a pitch, a yaw and a roll of the tool. The base structure of the adjustable mount may include a plurality of resiliently compressible structures for enabling adjustment of the position and the orientation of the tool.

One embodiment of an adjustable tool mount for coupling a tool to a tool positioning system may be summarized as including a base structure that is selectively deformable in each of a plurality of locations to adjust a position and an orientation of the tool relative to a base reference frame.

The base structure may be asymmetrically deformable at the plurality of locations to adjust an angular orientation of the tool with respect to at least two rotational degrees of freedom. The base structure may be asymmetrically deformable at the plurality of locations to adjust a pitch, a yaw and a roll of the tool. The base structure may include a plurality of resilient flexible structures for enabling adjustment of the position and the orientation of the tool. The base structure may be a unitary structure that is translationally adjustable in each of a plurality of orthogonal directions and adjustably bendable in at least two primary directions.

One embodiment of a method of adjusting a position and an orientation of a tool supported in a cantilevered manner by an adjustable tool mount of a multi-axis machine may be summarized as including: selectively deforming at least one resiliently compressible region of the adjustable tool mount to adjust the position of the tool; and selectively deforming at least one resiliently compressible region of the adjustable tool mount asymmetrically to adjust the orientation of the tool.

Selectively deforming the at least one resiliently compressible region of the adjustable tool mount to adjust the position of the tool may include adjusting a tension of each of a pair of independently adjustable adjustment mechanisms that pass through the at least one resiliently compressible region. Selectively deforming the at least one resiliently compressible region of the adjustable tool mount asymmetrically to adjust the orientation of the tool may include applying differential tensioning to a pair of independently adjustable adjustment mechanisms that pass through the at least one resiliently compressible region.

One embodiment of a method of adjusting a position and an orientation of a tool supported by an adjustable tool mount of a multi-axis machine may be summarized as including: guiding the tool or a tool indexing member to interact with a reference position device located within a working envelope of the multi-axis machine; and selectively deforming at least one resiliently compressible region of the adjustable tool mount to comply with the reference position device. In some instances, the reference position device may be a bushing with an alignment bore having a diameter slightly larger than an external diameter of a portion of the tool or the tool indexing member, and guiding the tool or the tool indexing member to interact with the reference position device may include guiding the tool or the tool indexing member into the alignment bore. The reference position device may be fixed relative to a base reference frame of the multi-axis machine and the alignment bore may be pre-aligned with an ideal orientation relative to the base reference frame. In some instances, guiding the tool or the tool indexing member to interact with the reference position device may include guiding a tool replacement rod received by the adjustable tool mount to interact with the reference position device. The alignment bore of the bushing may have a height-to-diameter ratio greater than one.

Selectively deforming the at least one resiliently compressible region of the adjustable tool mount to comply with the reference position device may include selectively deforming the at least one resiliently compressible region of the adjustable tool mount until the tool or the tool indexing member can travel freely axially within the alignment bore of the reference position device. The tool may be a cutting head of a fluid jet cutting system, and selectively deforming the at least one resiliently compressible region of the adjustable tool mount until the tool or the tool indexing member can travel freely axially within the alignment bore of the reference position device may include selectively deforming the at least one resiliently compressible region while the cutting head is operating at high pressure. The tool may be a cutting head of a fluid jet cutting system, and the method may further include operating the cutting head at different pressures to verify alignment of a portion of the cutting head with the alignment bore at the different pressures.

In some instances, the reference position device may comprise two perpendicular dial indicators with reference readings, and guiding the tool or the tool indexing member to interact with the reference position device may include guiding the tool or tool indexing member into engagement with the dial indicators. Selectively deforming the at least one resiliently compressible region of the adjustable tool mount to comply with the reference position device may include selectively deforming the at least one resiliently compressible region of the adjustable tool mount until the reference readings of the dial indicators do not change when the tool or the tool indexing member travels axially.

In other instances, the reference position device may be any other type of position measurement instrument.

DETAILED DESCRIPTION

Figure 1:
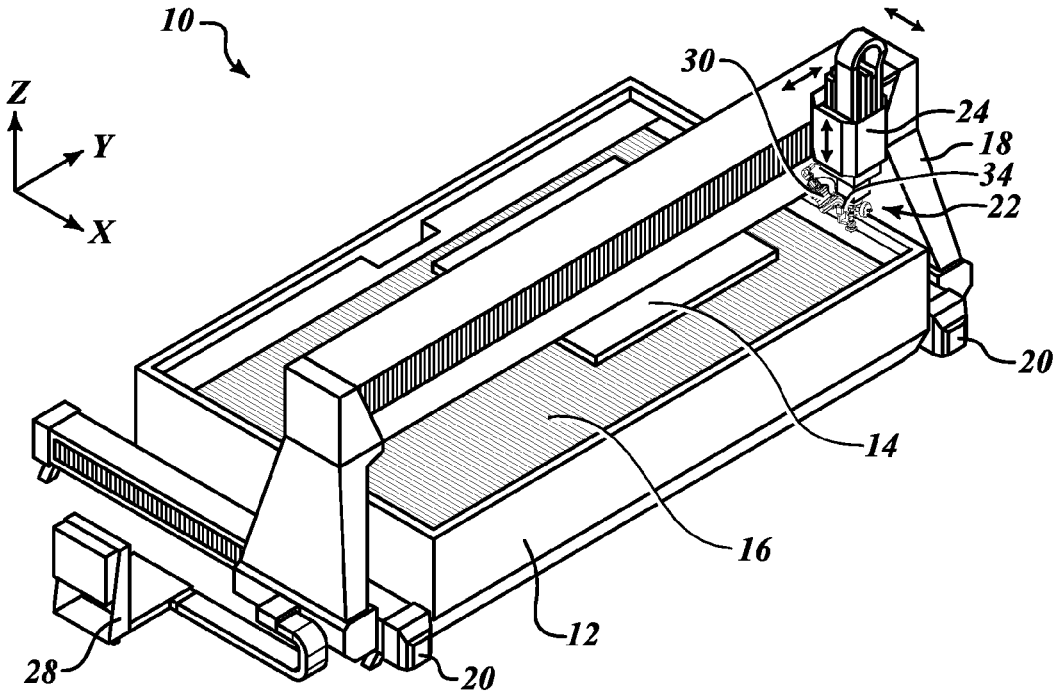
FIG. 1 is an isometric view of a multi-axis fluid jet cutting machine, according to one embodiment.

In the following description, certain specific details are set forth in order to provide a thorough understanding of various disclosed embodiments. However, one of ordinary skill in the relevant art will recognize that embodiments may be practiced without one or more of these specific details. In other instances, well-known structures associated with fluid jet cutting systems, other machining systems (e.g., drilling machines, mills, routers) and methods of operating the same may not be shown or described in detail to avoid unnecessarily obscuring descriptions of the embodiments. For instance, it will be appreciated by those of ordinary skill in the relevant art that a high-pressure fluid source and an abrasive source may be provided to feed high-pressure fluid and abrasives, respectively, to a cutting head of the fluid jet systems described herein to facilitate, for example, high-pressure or ultrahigh-pressure abrasive fluid jet cutting of workpieces. As another example, well-known control systems and drive components may be integrated into the fluid jet cutting systems and other machines to facilitate movement of the cutting head or other tool relative to the workpiece to be processed. These systems may include drive components to manipulate the cutting head or other tool about multiple rotational and translational axes, such as, for example, is common in five-axis positioning systems.

Unless the context requires otherwise, throughout the specification and claims which follow, the word "comprise" and variations thereof, such as "comprises" and "comprising," are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide enhanced systems and methods for adjusting the position and the orientation of an end effector of a multi-axis machine, such as, for example, a cutting head of a fluid jet cutting machine, relative to a base reference frame. Embodiments include, for example, a cutting head assembly of a fluid jet cutting system. The cutting head assembly may include a cutting head and an adjustable mount for the cutting head which is manipulable in space to position and orient the cutting head relative to the workpiece. As described herein, the term cutting head may refer generally to an assembly of components at a working end of the fluid jet cutting machine, and may include, for example, an orifice unit and/or nozzle of the fluid jet cutting system for generating a high-pressure fluid jet and surrounding structures and devices coupled directly or indirectly thereto to move in unison therewith. The cutting head may also be referred to as an end effector. Other tools that may be adjusted with embodiments of the adjustable mounts described herein include end effectors of other types of machines, such as, for example, tools of multi-axis milling or drilling machines, such as, for example, drill bits.

FIG. 1 shows an example embodiment of a fluid jet cutting system 10. The fluid jet cutting system 10 includes a catcher tank 12 which is configured to support a workpiece 14 on a platform 16 to be processed by the system 10. The catcher tank 12 includes a volume of water for absorbing energy of the cutting jet during cutting operations.

The fluid jet cutting system 10 further includes a bridge assembly 18 which is movable along a pair of base rails 20, and straddles the catcher tank 12. In operation, the bridge assembly 18 moves back and forth along the base rails 20 with respect to a translational axis X to position a cutting head 22 of the system 10 for processing the workpiece 14. A tool carriage 24 is movably coupled to the bridge assembly 18 to translate back and forth along another translational axis Y, which is aligned perpendicularly to the translational axis X. The tool carriage 24 is further configured to raise and lower the cutting head 22 along yet another translational axis Z to move the cutting head 22 toward and away from the workpiece 14. A manipulable forearm 30 and an adjustable mount 34 (or wrist) are provided intermediate the cutting head 22 and the tool carriage 24 to provide additional functionally.

Figure 2:
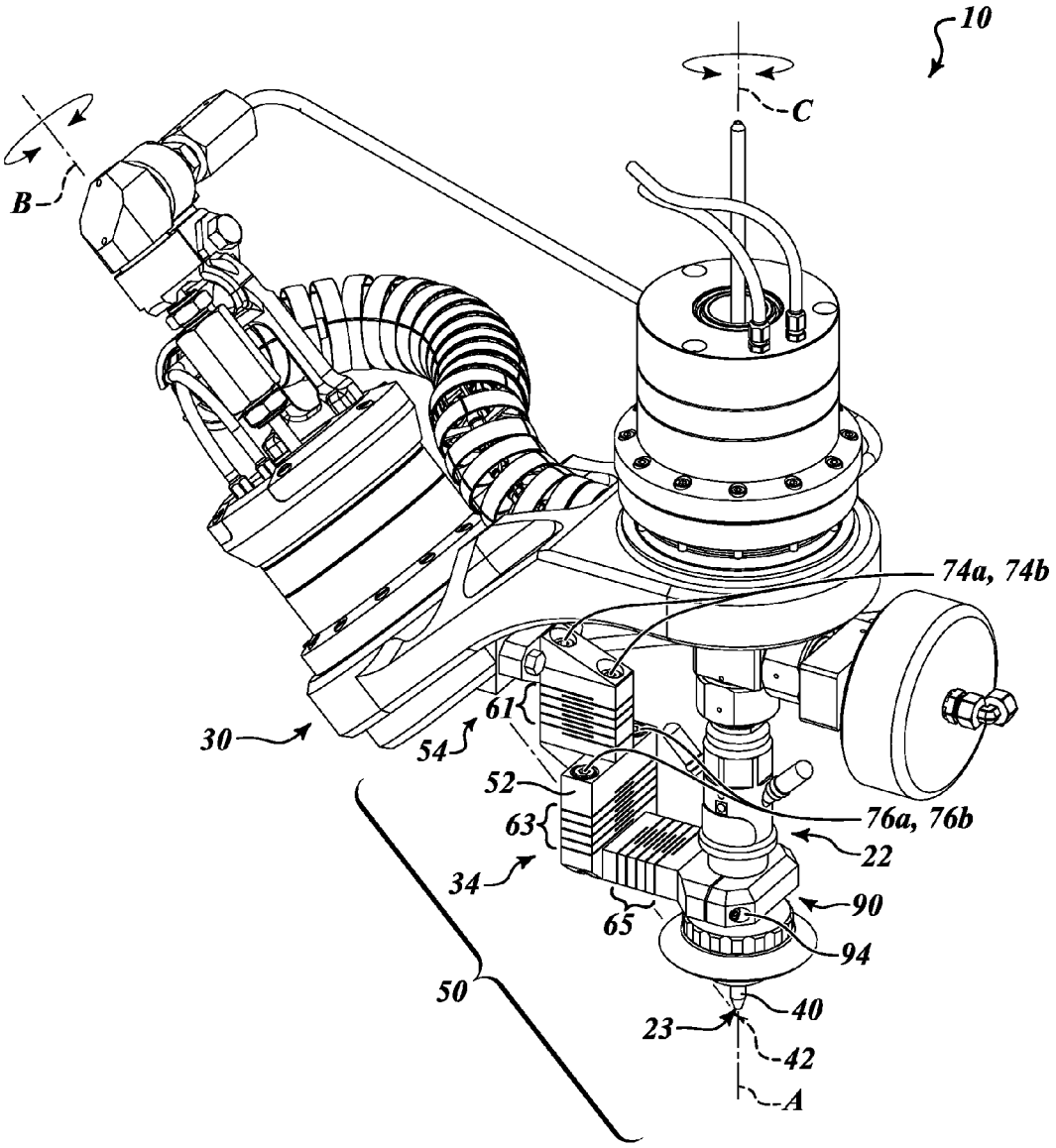
FIG. 2 is an isometric view of a cutting head assembly, according to one embodiment, of the fluid jet cutting machine of FIG. 1, which is shown coupled to a portion of a multi-axis positioning system (e.g., a five-axis positioning system).
Figure 3:
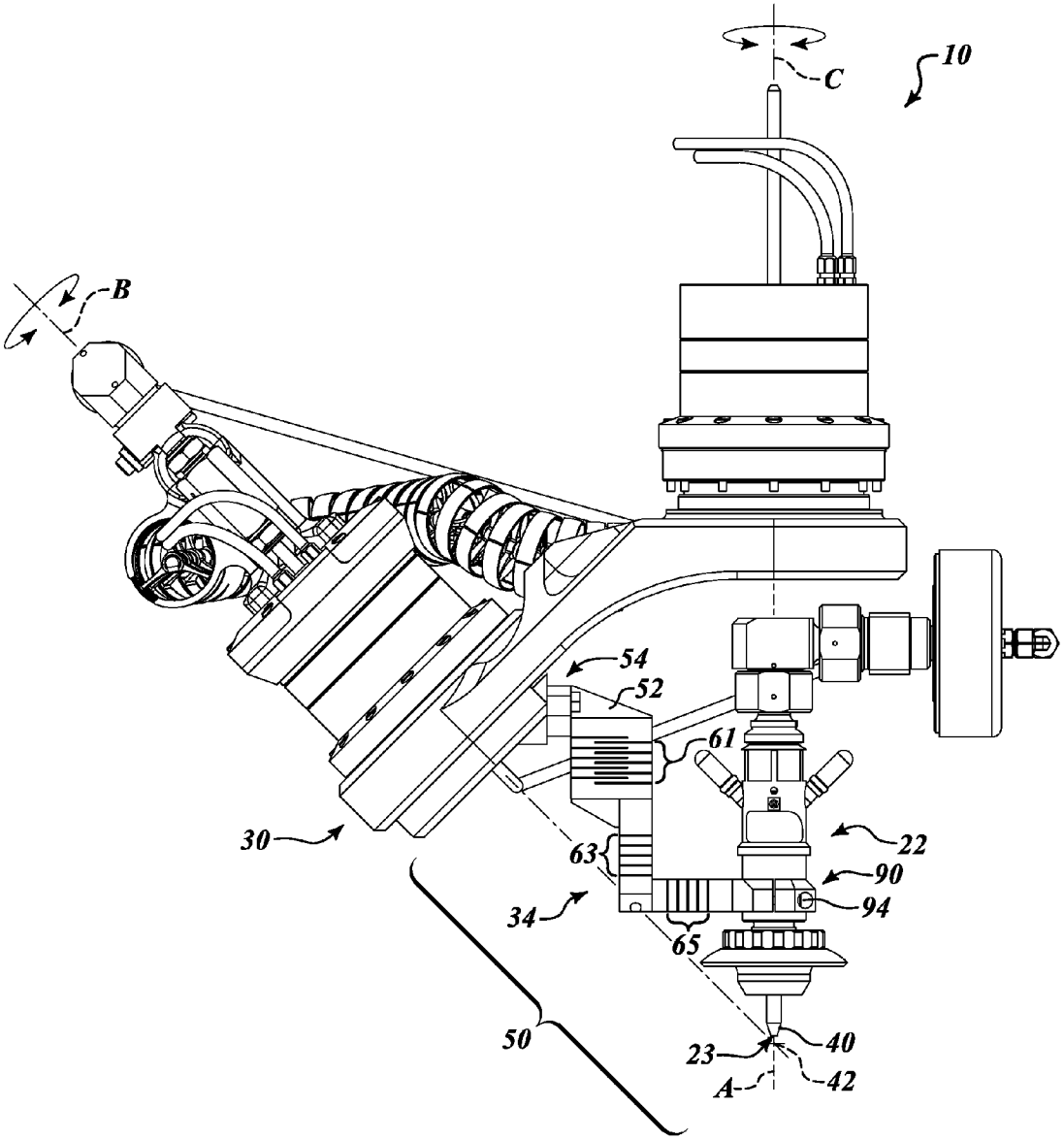
FIG. 3 is a side elevational view of the cutting head assembly and portion of the multi-axis positioning system of FIG. 2.

More particularly, with reference to FIGS. 2 and 3, the forearm 30 is rotatably coupled to the tool carriage 24 to rotate the cutting head 22 about an axis of rotation C and the adjustable mount 34 is rotatably coupled to the forearm 30 to rotate the cutting head 22 about another axis of rotation B that is non-parallel to the aforementioned rotational axis C. In combination, the rotational axes B, C enable the cutting head 22 to be manipulated in a wide range of orientations relative to the workpiece 14 to facilitate, for example, cutting of complex profiles including three-dimensional shapes. Moreover, the adjustable mount 34 enables the position and orientation of the cutting head 22 to be readily adjusted as described in more detail herein. Among other things, this can be advantageous to adjust or compensate for tolerance stackup that would otherwise result in the cutting head 22 being out of alignment upon machine setup.

With continued reference to FIGS. 2 and 3, the rotational axes B, C may converge at a focal point 42 which, in some embodiments, may be offset from the end or tip of a nozzle or mixing tube 40 of the cutting head 22. The end or tip of the nozzle or mixing tube 40 of the cutting head 22 is preferably positioned to maintain a desired standoff distance from the workpiece to be processed. The standoff distance may be selected to optimize the cutting performance of the waterjet, and, in some embodiments, may range between about 0.010 inches and about 0.100 inches.

During operation, movement of the cutting head 22 with respect to each of the translational axes X, Y, Z and rotational axes B, C may be accomplished by various conventional drive components and an appropriate control system 28 (FIG. 1) which includes a configured computing system. Other well-known systems associated with fluid jet cutting machines may also be provided such as, for example, a high-pressure or ultrahigh-pressure fluid source (e.g., direct drive and intensifier pumps with pressure ratings ranging from 40,000 psi to 100,000 psi. and higher) for supplying high-pressure or ultrahigh-pressure fluid to the cutting head 22 and/or an abrasive source (e.g., abrasive hopper and distribution system) for feeding abrasives to the cutting head 22 to enable abrasive fluid jet cutting. In some embodiments, a vacuum device may be provided to assist in drawing abrasives into the fluid from the fluid source to produce a consistent abrasive fluid jet to enable particularly accurate and efficient workpiece processing. Details of the control system 28, conventional drive components and other well-known systems associated with fluid jet cutting systems, however, are not shown or described in detail to avoid unnecessarily obscuring descriptions of the embodiments.

Embodiments described herein provide enhanced systems and methods for adjusting the position and orientation of an end effector of a multi-axis machine relative to a base reference frame. For example, the embodiment shown in FIGS. 1 through 6 provides for adjusting the position and orientation of a manipulable cutting head 22 of a fluid jet cutting system 10 relative to a base reference frame 13 (FIG. 4), which may be defined by features at a proximate end 54 of the adjustable mount 34, such as, for example, a planar mounting face 59 that is provided for interfacing the adjustable mount 34 with the forearm 30 of the multi-axis positioning system of the fluid jet cutting system 10. Although embodiments are discussed herein in terms of high-pressure fluid jet cutting machines, including abrasive waterjet cutting machines, one skilled in the relevant art will recognize that aspects and techniques of the present invention can be applied and used in connection with various other types of multi-axis machines, such as, for example, multi-axis CNC milling machines.

With reference to FIGS. 2 and 3, a cutting head assembly 50 includes a cutting head 22 through which fluid passes during operation to generate a high-pressure fluid jet for processing a workpiece 14 which is discharged via an outlet 23 of the cutting head 22. The cutting head assembly 50 further includes an adjustable mount 34 that couples the cutting head 22 to a forearm 30 of a multi-axis positioning system. As previously described, the forearm 30 is rotatably coupled to a tool carriage 24 (FIG. 1) to rotate the cutting head 22 about an axis of rotation C and the adjustable mount 34 is rotatably coupled to the forearm 30 to rotate the cutting head 22 about another axis of rotation B that is non-parallel to the aforementioned rotational axis C. In combination, the rotational axes B, C enable the cutting head 22 to be manipulated in a wide range of orientations relative to the workpiece 14 to facilitate, for example, cutting of complex profiles including three-dimensional shapes.

Figure 4:
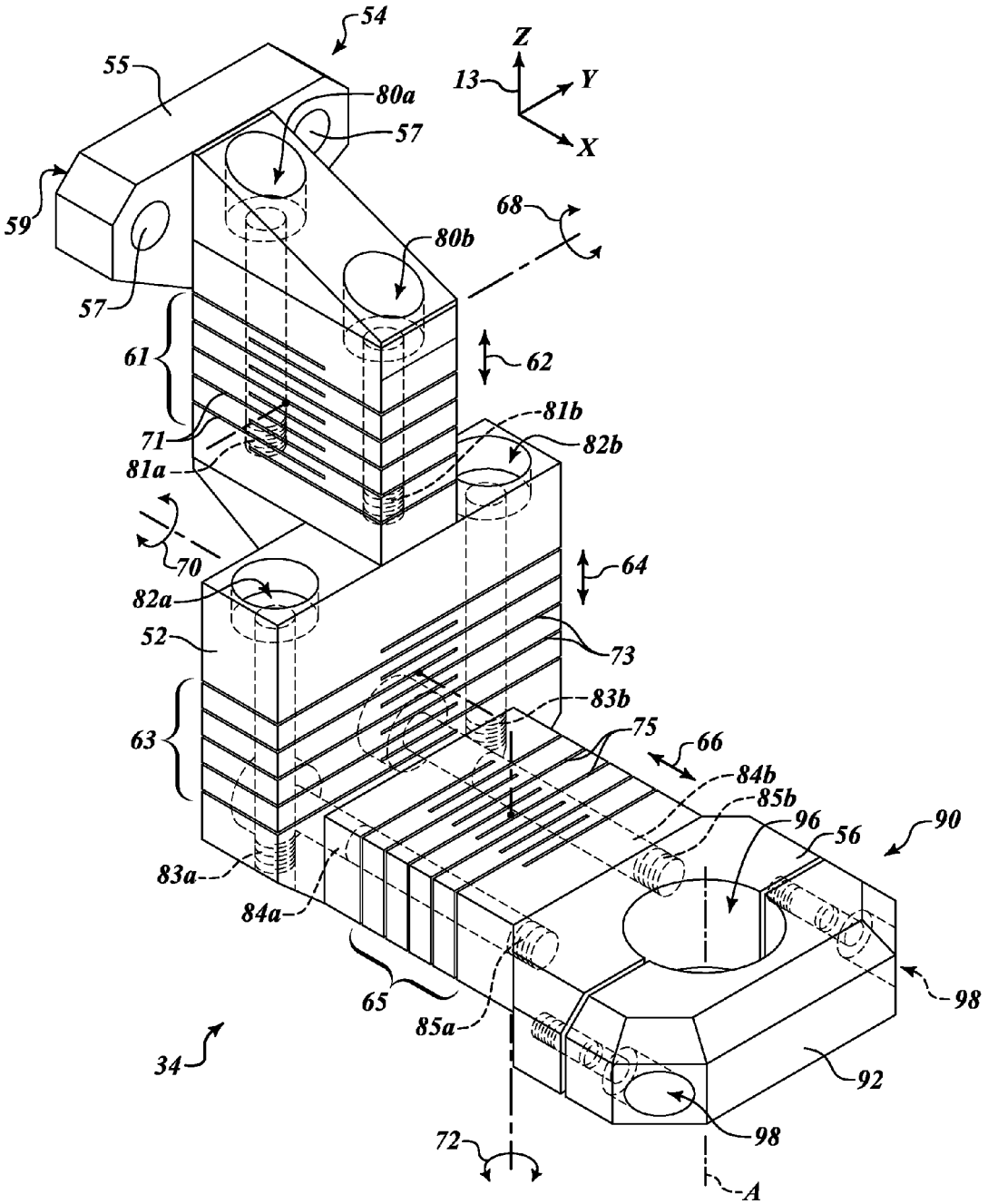
FIG. 4 is an isometric view of the adjustable mount of the cutting head assembly of FIG. 2.

With reference to FIGS. 2 through 4, the adjustable mount 34 includes a base structure 52 that is selectively deformable in each of a plurality of different portions or regions 61, 63, 65 to adjust a position of the outlet 23 of the cutting head 22 held by the adjustable mount 34 in a plurality of orthogonal directions relative to a base reference frame 13, as indicated by the double-headed arrows labeled 62, 64 and 66 shown in FIG. 4. Each of the portions or regions 61, 63, 65 of the base structure 52 are also asymmetrically deformable to adjust an orientation of the cutting head 22, or central axis A thereof, or more particularly, a pitch, a yaw and a roll of the cutting head 22, as indicated by the double-headed arrows labeled 68, 70 and 72 shown in FIG. 4.

With reference to FIG. 4, a first elastically deformable portion or region 61 is provided to enable vertical translational adjustment, as indicated by double-headed arrow 62, and pitch adjustment, as indicated by double-headed arrow 68. Translational adjustment in the vertical direction is provided by extending or contracting opposing sides of the first elastically deformable portion or region 61 together, and pitch adjustment is provided by differentially extending or contracting opposing sides of the first elastically deformable portion or region 61. This may be accomplished, for example, by adjustment mechanisms, such as threaded fasteners 74*a*, 74*b* (FIG. 2), provided at and extending through each of the opposing sides of the first elastically deformable portion or region 61. For instance, threaded fasteners 74*a*, 74*b* may be provided to pass through corresponding passages 80*a*, 80*b* in each of opposing sides of the first elastically deformable portion or region 61 and to engage corresponding internal threads 81*a*, 81*b* provided therein. The threaded fasteners 74*a*, 74*b* may be tightened or loosened to provide vertical translational adjustment. Additionally, differential tightening or loosening may be applied to the fasteners 74*a*, 74*b* to provide pitch adjustment by asymmetrically deforming the first elastically deformable portion or region 61.

The first elastically deformable portion or region 61 may be resilient and flexible under high compressive loads. In some instances, the first elastically deformable portion or region 61 may comprise a serpentine body defined by a series of interdigitated slots 71 extending from exterior sides thereof. The interdigitated slots 71 provide space to enable the position/orientation adjustment described herein while the remaining structure of the serpentine body provides sufficient structural robustness and rigidity to support the cutting head 22 during operation without significant bending under dynamic loading conditions. The rigidity or stiffness of the first elastically deformable portion or region 61 may be varied or controlled either by material selection, the number of the slots, the width of the slots, the depth of penetration of the slots, a combination thereof or other variables such as the cross-sectional shape of the first elastically deformable portion or region 61.

With continued reference to FIG. 4, a second elastically deformable portion or region 63 is provided to enable further vertical translational adjustment, as indicated by double-headed arrow 64, and roll adjustment, as indicated by double-headed arrow 70. Translational adjustment in the vertical direction is provided by extending or contracting opposing sides of the second elastically deformable portion or region 63 together, and roll adjustment is provided by differentially extending or contracting the opposing sides of the second elastically deformable portion or region 63. This may be accomplished, for example, by adjustment mechanisms, such as threaded fasteners 76*a*, 76*b* (FIG. 2), provided at and extending through each of the opposing sides of the second elastically deformable portion or region 63. For instance, threaded fasteners 76*a*, 76*b* may be provided to pass through corresponding passages 82*a*, 82*b* in each of opposing sides of the second elastically deformable portion or region 63 and to engage corresponding internal threads 83*a*, 83*b* provided therein. The threaded fasteners 76*a*, 76*b* may be tightened or loosened to provide vertical translational adjustment. Additionally, differential tightening or loosening may be applied to the fasteners 76*a*, 76*b* to provide roll adjustment by asymmetrically deforming the second elastically deformable portion or region 63.

The second elastically deformable portion or region 63 may be resilient and flexible under high compressive loads. In some instances, the second elastically deformable portion or region 63 may comprise a serpentine body defined by a series of interdigitated slots 73 extending from exterior sides thereof. The interdigitated slots 73 provide space to enable the position/orientation adjustment described herein while the remaining structure of the serpentine body provides sufficient structural robustness and rigidity to support the cutting head 22 during operation without significant bending under dynamic loading conditions. The rigidity or stiffness of the second elastically deformable portion or region 63 may be varied or controlled either by material selection, the number of the slots, the width of the slots, the depth of penetration of the slots, a combination thereof or other variables such as the cross-sectional shape of the second elastically deformable portion or region 63.

With continued reference to FIG. 4, a third elastically deformable portion or region 65 is provided to enable fore and aft translational adjustment, as indicated by double-headed arrow 66, and yaw adjustment, as indicated by double-headed arrow 72. Translational adjustment in the fore and aft direction is provided by extending or contracting opposing sides of the third elastically deformable portion or region 65 together, and yaw adjustment is provided by differentially extending or contracting the opposing sides of the third elastically deformable portion or region 65. This may be accomplished, for example, by adjustment mechanisms, such as threaded fasteners (not shown), provided at and extending through each of the opposing sides of the third elastically deformable portion or region 65. For instance, threaded fasteners may be provided to pass through corresponding passages 84*a*, 84*b* in each of opposing sides of the third elastically deformable portion or region 65 and to engage corresponding internal threads 85*a*, 85*b* provided therein. The threaded fasteners may be tightened or loosened to provide fore and aft translational adjustment. Additionally, differential tightening or loosening may be applied to the fasteners to provide yaw adjustment by asymmetrically deforming the third elastically deformable portion or region 65.

Figure 5:
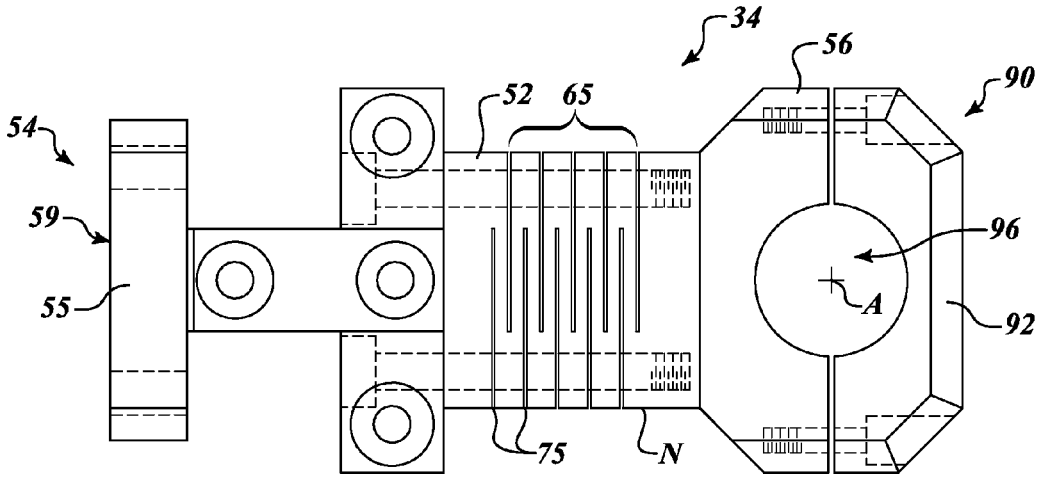
FIG. 5 is a top plan view of the adjustable mount of FIG. 4, shown in a neutral configuration.
Figure 6:
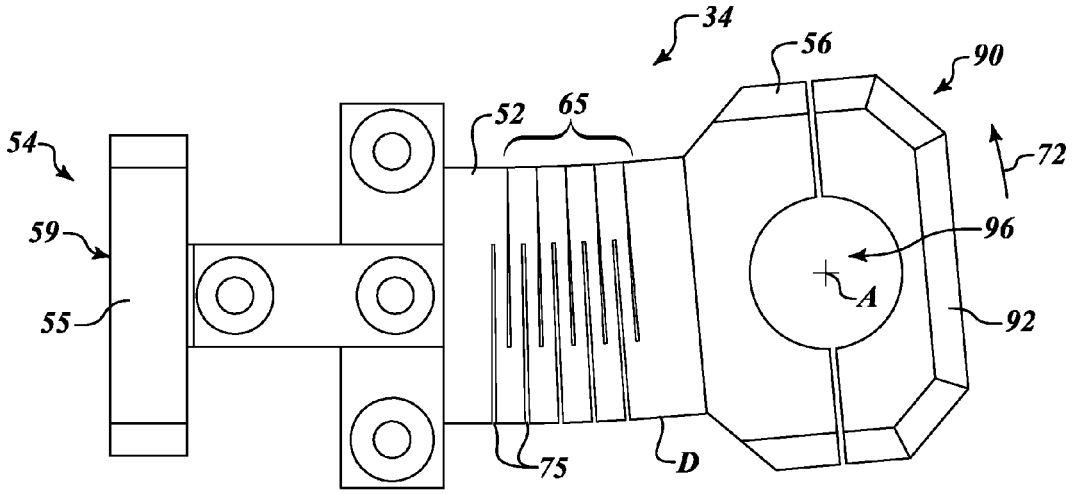
FIG. 6 is a top plan view of the adjustable mount of FIG. 4, shown in an elastically deformed configuration.

As an example, FIGS. 5 and 6 provide, respectively, top plan views of the adjustable mount 34 with the third elastically deformable portion or region 65 shown in a neutral configuration N, in which no differential loading has been applied, and in a deformed configuration D, in which differential loading has been applied to impart lateral bending of the adjustable mount 34 in the direction indicated by the arrow 72. As can be appreciated from FIGS. 5 and 6, the interdigitated slots 75 on one side of the third elastically deformable portion or region 65 narrow and the interdigitated slots 75 on the other side of the third elastically deformable portion or region 65 widen as the deformable portion or region 65 moves from the neutral configuration N shown in FIG. 5 to the deformed configuration in FIG. 6. Similar functionality is provided by the other deformable portions or regions 61, 63.

Similar to the first and second deformable portions or regions 61, 63, the third elastically deformable portion or region 65 may be resilient and flexible under high compressive loads. In some instances, the third elastically deformable portion or region 65 may comprise a serpentine body defined by a series of interdigitated slots 75 extending from exterior sides thereof. The interdigitated slots 75 provide space to enable the position/orientation adjustment described herein while the remaining structure of the serpentine body provides sufficient structural robustness and rigidity to support the cutting head 22 during operation without significant bending under dynamic loading conditions. The rigidity or stiffness of the third elastically deformable portion or region 65 may also be varied or controlled either by material selection, the number of slots, the width of the slots, the depth of penetration of the slots, a combination thereof or other variables such as the cross-sectional shape of the third elastically deformable portion or region 65.

Although each of the adjustment mechanisms are shown as threaded fasteners 74*a*, 74*b*, 76*a*, 76*b*, such as socket head cap screws, which engage corresponding internal threads 81*a*, 81*b*, 83*a*, 83*b*, 85*a*, 85*b* formed in the base structure 52 of the adjustable mount 34, it is appreciated that the adjustment mechanisms may take on other forms for selectively applying compressive loads to opposing sides of the various elastically deformable portions or regions 61, 63, 65. For example, in some instances, tie rods with separate threaded nuts may be used in lieu of the internal threads 81*a*, 81*b*, 83*a*, 83*b*, 85*a*, 85*b* to selectively deform the various elastically deformable portions or regions 61, 63, 65.

Each of the adjustment mechanisms may be adjusted independently of each other to enable differential loading of the various elastically deformable portions or regions 61, 63, 65 to provide the orientation adjustment described herein. Moreover, each of the adjustment mechanisms may be locked in a selected position upon reaching a desired adjustment. In some instances, for example, lock washers or thread-locking fluid may be used to prevent or resist unintentional movement of the adjustment mechanisms from a desired position or setting.

Although three distinct elastically deformable portions or regions 61, 63, 65 are provided in the example embodiment of the adjustable mount 34 shown in FIGS. 2 through 6, it is appreciated that in other embodiments, an adjustable tool mount may include more or fewer regions that are selectively deformable to provide a wide range of position and orientation adjustability, including in non-orthogonal directions.

The example embodiment of the adjustable mount 34 shown in FIGS. 2 through 6 includes a base structure 52 having subcomponents that are welded together to form a single, unitary structure. In other instances, the base structure may be a single, unitary structure made from machining, casting, forging or other manufacturing processes, including, for example, additive manufacturing processes. The unitary structure may be translationally adjustable in each of a plurality of orthogonal directions and adjustably bendable in at least three primary directions, such as, for example, lateral, vertical and torsional directions, as indicated by the double-headed arrows labeled 68, 70 and 72 in FIG. 4. In other embodiments, the base structure may include subcomponents that are bolted or otherwise removably coupled together to form a non-unitary support structure. The adjustable mount 34 may have an overall form that resembles an "L" shape or that is otherwise configured to support the cutting head 22 in a cantilevered manner.

With reference to FIG. 4, the adjustable mount 34 may further include a clamp device 90 that is configured to receive an end effector, such as cutting head 22 (FIGS. 2 and 3). As an example, the clamp device 90 may include a distal end 56 of the base structure 52, a separate clamping block 92 and fasteners 94 (FIG. 2). The clamp device 90 may be used to sandwich or clamp the cutting head 22 between the distal end 56 of the base structure 52 and the clamping block 92. Each of the distal end 56 of the base structure 52 and the clamping block 92 may be shaped to correspond to a respective portion of the cutting head 22 such that the cutting head 22 nests tightly within a receiving aperture 96 defined by the clamp device 90. The distal end 56 of the base structure 52 and the clamping block 92 may include passages 98 for accommodating the fasteners 94 (FIG. 4) and allowing the clamping force of the clamp device 90 to be readily adjusted.

With reference to FIG. 4, the adjustable mount 34 may further include features at a proximate end 54 of the adjustable mount 34, such as, for example, a mounting structure 55 with a planar mounting face 59 that is provided for interfacing the adjustable mount 34 with the forearm 30 (FIGS. 2 and 3) of the multi-axis positioning system of the fluid jet cutting system 10. Apertures 57 may be provided in the mounting structure 55 for coupling the adjustable mount 34 to the forearm 30 with threaded fasteners, for example. The interface between the forearm 30 and the mounting structure 55 of the adjustable mount 34 may define the base reference frame 13 from which position and orientation adjustments can be made. It is appreciated, however, that the base reference frame 13 can be based on other features or may otherwise be relatable to a reference frame of the positioning system which is used to drive and manipulate the adjustable mount 34 and cutting head 22 during operation.

In accordance with the embodiments of the adjustable mounts 34 and related components and assemblies described herein, related methods of adjusting a position and an orientation of a tool are also provided. For instance, in some embodiments, a method of adjusting a position and an orientation of a tool supported in a cantilevered manner by an adjustable tool mount of a multi-axis machine may be provided which includes selectively deforming at least one resiliently compressible region of the adjustable tool mount to adjust the position of the tool and/or selectively deforming at least one resiliently compressible region of the adjustable tool mount asymmetrically to adjust the orientation of the tool.

Selectively deforming one or more resiliently compressible regions of the adjustable tool mount may include adjusting a tension of each of a respective pair of independently adjustable adjustment mechanisms that pass through each resiliently compressible region, or applying differential tensioning to each respective pair of independently adjustable adjustment mechanisms. Each region may be adjusted sequentially and iteratively to arrive at a desired tool location. The method may further include measuring a position and/or orientation of the tool and further adjusting the positional and/or orientation of the tool based on said measurements. Again, adjusting the position and the orientation of the tool may include selectively deforming one or more resiliently compressible regions of the adjustable tool mount. The method may further include locking the adjustment mechanisms such that the tool remains in a desired position for subsequent machining operations. The method may further include checking the position and/or orientation of the tool periodically and making further adjustments if necessary to account for any inaccuracies.

Figure 7:
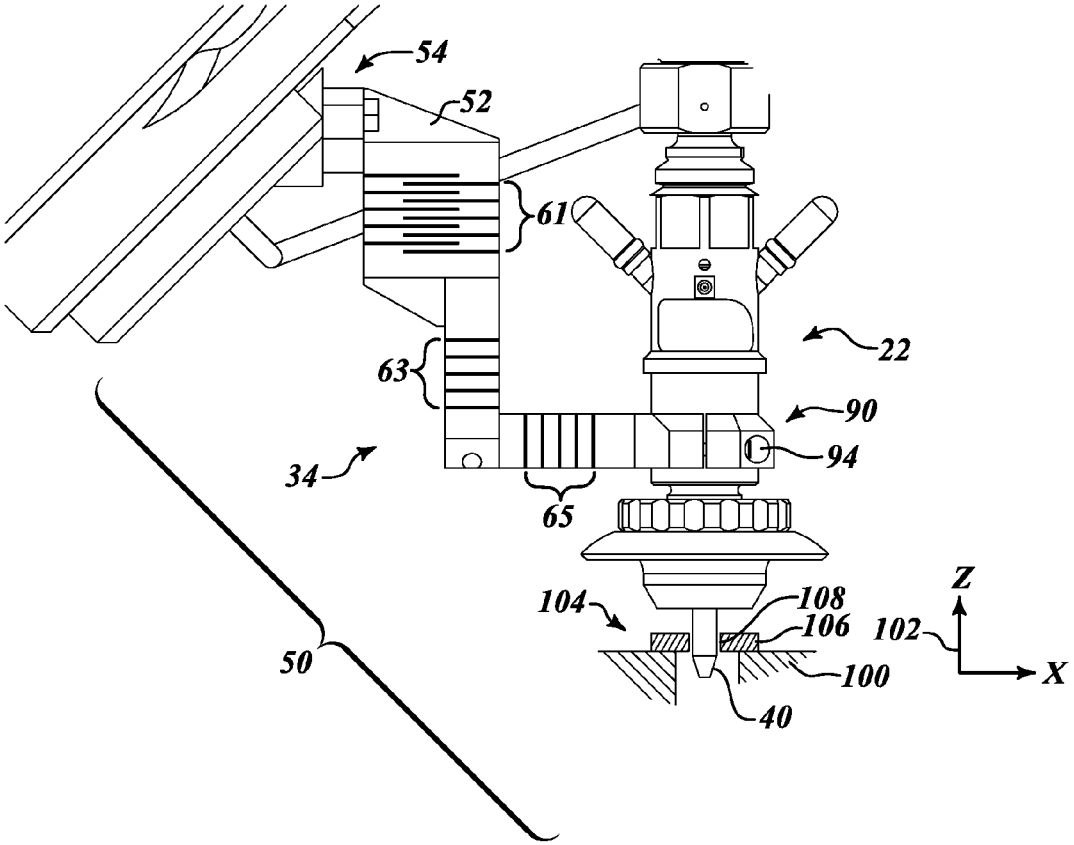
FIG. 7 is a side elevational view of the cutting head assembly of FIG. 2 shown interacting with a reference position device, according to one embodiment.
Figure 8:
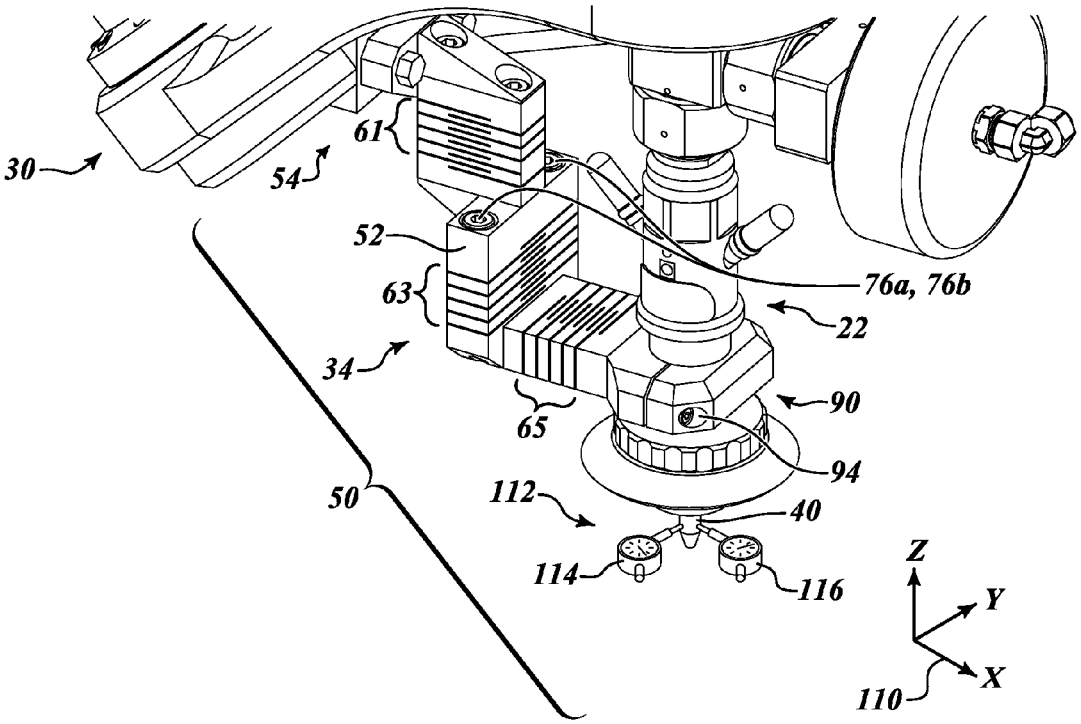
FIG. 8 is an isometric view of the cutting head assembly of FIG. 2 shown interacting with a reference position device, according to another embodiment.

According to other embodiments, and with reference to FIGS. 7 and 8, a method of adjusting a position and an orientation of a tool supported by an adjustable tool mount of a multi-axis machine may be provided that includes guiding the tool or a tool indexing member to interact with a reference position device 104, 112 located within a working envelope of the multi-axis machine and selectively deforming at least one resiliently compressible region 61, 63, 65 of the adjustable tool mount 34 to comply with the reference position device 104, 112.

With reference to FIG. 7, the reference position device 104 may be a bushing 106 with an alignment bore 108 having a diameter slightly larger than an external diameter of a portion (e.g., nozzle or mixing tube 40) of the tool (e.g., cutting head 22) or the tool indexing member, and guiding the tool or the tool indexing member to interact with the reference position device 104 may include guiding the portion (e.g., nozzle or mixing tube 40) of the tool or the tool indexing member into the alignment bore 108. The reference position device 104 may be fixed relative to a base reference frame 102 of the multi-axis machine defined by a base or environment 100 of the machine. The alignment bore 108 of the bushing 106 may be prealigned with an ideal orientation relative to the base reference frame 102. For example, a central axis of the alignment bore 108 may be prealigned precisely with a vertical Z-axis of the base reference frame 102.

In some instances, the method may include guiding a tool replacement rod (not shown) that is received by the adjustable tool mount 34 to interact with the reference position device 104. The tool replacement rod, when provided, may be made of a different material and/or may have a different size and/or shape than the tool that it may temporarily replace. For example, the tool replacement rod may be secured to the cutting head 22 shown in FIG. 7 in place of the nozzle or mixing tube 40 and may have a different size and/or shape than the nozzle or mixing tube 40. In such cases, the alignment bore 108 of the bushing 106 may be correspondingly sized to the replacement rod rather than the nozzle or mixing tube 40. In other instances, an indexing member, such as an alignment rod, may be coupled to the adjustable tool mount 34 in addition to the nozzle or mixing tube 40 and may be provided in a parallel arrangement with a central axis the nozzle or mixing tube 40.

In some instances, the alignment bore 108 of the bushing 106 may have a height-to-diameter ratio greater than one such that the sidewall of the bushing 106 surrounding the alignment bore 108 extends for a sufficient distance to enable accurate adjustment of the tool position and/or orientation.

According to some embodiments, selectively deforming at least one resiliently compressible region 61, 63, 65 of the adjustable tool mount 34 to comply with the reference position device 104 may include selectively deforming one or more resiliently compressible regions 61, 63, 65 of the adjustable tool mount 34 until the tool or the tool indexing member can travel freely axially within the alignment bore 108 of the reference position device 104 (e.g., bushing 106).

In some instances, the tool may be a cutting head 22 of a fluid jet cutting system, as shown in FIG. 7, and selectively deforming at least one resiliently compressible region 61, 63, 65 of the adjustable tool mount 34 until the tool or the tool indexing member can travel freely axially within the alignment bore 108 of the reference position device 104 may include selectively deforming one or more of the resiliently compressible regions 61, 63, 65 while the cutting head 22 is operating at high pressure. Accordingly, in this manner, the method may compensate for position and/or orientation misalignment of the cutting head 22 that might otherwise arise during operation from pressurizing the system. In some embodiments, the method may further include operating the cutting head 22 at a selection of different pressures to verify alignment of a portion (e.g., nozzle or mixing tube 40) of the cutting head 22 with the alignment bore 108 at the different pressures. In this manner, adjustment or compensation for changes in the position and/or the alignment of the nozzle or mixing tube 40 that might occur at the different operating pressures may be provided.

With reference to FIG. 8, and according to other embodiments, the reference position device 112 may comprise two perpendicular dial indicators 114, 116 with reference readings, and guiding the tool or the tool indexing member to interact with the reference position device 112 may include guiding the tool or tool indexing member into engagement with the dial indicators 114, 116. Selectively deforming at least one resiliently compressible region 61, 63, 65 of the adjustable tool mount 34 to comply with the reference position device 112 may include selectively deforming one or more resiliently compressible regions 61, 63, 65 of the adjustable tool mount 34 until the reference readings of the dial indicators 114, 116 do not change when the tool or the tool indexing member travels axially (e.g., in the Z-axis direction defined by base reference frame 110). In other instances, the reference position device 112 may comprise any other type of position measurement instrument, such as, for example, one or more laser position sensors or inductance position sensors.

Although certain specific details are shown and described with reference to the example embodiment of the adjustable mount 34 shown in FIGS. 2 through 8, one skilled in the relevant art will recognize that other embodiments may be practiced without one or more of these specific details. For example, one or more embodiments of an adjustable mount for a machine tool may lack the specific arrangement of the deformable portions or regions 61, 63, 65 shown in the example embodiment of FIGS. 2 through 8 and instead may include more or fewer deformable portions or regions, or may include similar deformable portions or regions arranged in a different order or arrangement. In addition, embodiments of other adjustable mounts may lack the specific arrangement of interdigitated slots 71, 73, 75 and instead include other features that enable selective deformation of the adjustable mounts.

Moreover, aspects and features of the various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A cutting head assembly of a fluid jet cutting system having a positioning system for moving the cutting head assembly, the cutting head assembly comprising:

a cutting head through which fluid passes during operation to generate a high-pressure fluid jet for processing a workpiece; and an adjustable mount for the cutting head which is manipulable in space by the positioning system to position and orient the cutting head relative to the workpiece during processing of the workpiece, the adjustable mount having a base structure including a plurality of resiliently compressible structures that are selectively deformable via at least one respective adjustment mechanism provided for and associated with each resiliently compressible structure to adjust a position and an orientation of the cutting head relative to a base reference frame prior to processing of the workpiece in order to improve system accuracy and performance when the cutting head and the adjustable mount are manipulated in space by the positioning system during processing of the workpiece.

2. The cutting head assembly of claim 1 wherein the base structure of the adjustable mount is asymmetrically deformable at a plurality of locations corresponding to the resiliently compressible structures to adjust an angular orientation of the cutting head with respect to at least two rotational degrees of freedom.

3. The cutting head assembly of claim 1 wherein the base structure of the adjustable mount is asymmetrically deformable at a plurality of locations corresponding to the resiliently compressible structures to adjust a pitch, a yaw and a roll of the cutting head.

4. The cutting head assembly of claim 1 wherein each resiliently compressible structure comprises a serpentine body.

5. The cutting head assembly of claim 1 wherein a respective pair of independently adjustable adjustment mechanisms are provided for and associated with each of the resiliently compressible structures.

6. The cutting head assembly of claim 5 wherein the base structure of the adjustable mount is configured such that differential adjustment of each pair of adjustment mechanisms causes the base structure to bend away from a neutral configuration.

7. The cutting head assembly of claim 5 wherein the base structure of the adjustable mount is configured such that equal adjustment of each pair of adjustment mechanisms causes the base structure to extend or contract linearly along a respective orthogonal direction.

8. The cutting head assembly of claim 1 wherein the base structure of the adjustable mount is a unitary structure that is translationally adjustable in each of a plurality of orthogonal directions and adjustably bendable in at least two primary directions.

9. The cutting head assembly of claim 8 wherein the unitary structure is adjustably bendable in lateral, vertical and torsional directions.

10. A machine comprising:

a tool for processing a workpiece;

a tool positioning system for manipulating the tool in space to carry out the processing of the workpiece; and an adjustable mount coupled between the tool and the tool positioning system, the adjustable mount having a base structure including a plurality of resiliently compressible structures that are selectively deformable via at least one respective adjustment mechanism provided for and associated with each resiliently compressible structure to adjust a position and an orientation of the tool relative to a base reference frame prior to processing of the workpiece in order to improve system accuracy and performance when the tool and the adjustable mount are manipulated in space by the tool positioning system during processing of the workpiece.

11. The machine of claim 10 wherein the base structure of the adjustable mount is asymmetrically deformable at a plurality of locations corresponding to the resiliently compressible structures to adjust an angular orientation of the tool with respect to at least two rotational degrees of freedom.

12. The machine of claim 10 wherein the base structure of the adjustable mount is asymmetrically deformable at a plurality of locations corresponding to the resiliently compressible structures to adjust a pitch, a yaw and a roll of the tool.

13. An adjustable tool mount for coupling a tool to a tool positioning system that is operable to manipulate the tool in space for processing a workpiece, the adjustable tool mount comprising:

a base structure including a plurality of resiliently compressible structures that are selectively deformable via at least one respective adjustment mechanism provided for and associated with each resiliently compressible structure to adjust a position and an orientation of the tool relative to a base reference frame prior to processing of the workpiece in order to improve system accuracy and performance when the tool and the adjustable mount are manipulated in space by the tool positioning system during processing of the workpiece.

14. The adjustable tool mount of claim 13 wherein the base structure is asymmetrically deformable at a plurality of locations corresponding to the resiliently compressible structures to adjust an angular orientation of the tool with respect to at least two rotational degrees of freedom.

15. The adjustable tool mount of claim 13 wherein the base structure is asymmetrically deformable at a plurality of locations corresponding to the resiliently compressible structures to adjust a pitch, a yaw and a roll of the tool.

16. The adjustable tool mount of claim 13 wherein the base structure is a unitary structure that is translationally adjustable in each of a plurality of orthogonal directions and adjustably bendable in at least two primary directions.

17. A method of adjusting a position and an orientation of a tool supported in a cantilevered manner by an adjustable tool mount of a multi-axis machine prior to processing of a workpiece in order to improve system accuracy and performance when the tool and the adjustable tool mount are manipulated in space by the multi-axis machine during processing of the workpiece, the method comprising:

prior to processing of the workpiece, selectively deforming at least one resiliently compressible region from among a plurality of resiliently compressible regions of the adjustable tool mount via one or more associated adjustment mechanisms to adjust the position of the tool; and selectively deforming at least one resiliently compressible region from among the plurality of resiliently compressible regions of the adjustable tool mount asymmetrically via one or more associated adjustment mechanisms to adjust the orientation of the tool.

18. The method of claim 17 wherein selectively deforming the at least one resiliently compressible region from among the plurality of resiliently compressible regions of the adjustable tool mount to adjust the position of the tool includes adjusting a tension of each of a pair of independently adjustable adjustment mechanisms that pass through and are associated with the at least one resiliently compressible region.

19. The method of claim 17 wherein selectively deforming the at least one resiliently compressible region from among the plurality of resiliently compressible regions of the adjustable tool mount asymmetrically to adjust the orientation of the tool includes applying differential tensioning to a pair of independently adjustable adjustment mechanisms that pass through and are associated with the at least one resiliently compressible region.

20. A method of adjusting a position and an orientation of a tool supported by an adjustable tool mount of a multi-axis machine, the method comprising:

guiding the tool or a tool indexing member to interact with a reference position device located within a working envelope of the multi-axis machine; and selectively deforming at least one resiliently compressible region of the adjustable tool mount to comply with the reference position device.

21. The method of claim 20 wherein the reference position device is a bushing with an alignment bore having a diameter slightly larger than an external diameter of a portion of the tool or the tool indexing member, and wherein guiding the tool or the tool indexing member to interact with the reference position device includes guiding the tool or the tool indexing member into the alignment bore.

22. The method of claim 21 wherein the reference position device is fixed relative to a base reference frame of the multi-axis machine and the alignment bore is prealigned with an ideal orientation relative to the base reference frame.

23. The method of claim 21 wherein guiding the tool or the tool indexing member to interact with the reference position device includes guiding a tool replacement rod received by the adjustable tool mount to interact with the reference position device.

24. The method of claim 21 wherein the alignment bore of the bushing has a height-to-diameter ratio greater than one.

25. The method of claim 20 wherein selectively deforming the at least one resiliently compressible region of the adjustable tool mount to comply with the reference position device includes selectively deforming at least one resiliently compressible region of the adjustable tool mount until the tool or the tool indexing member can travel freely axially within the alignment bore of the reference position device.

26. The method of claim 25 wherein the tool is a cutting head of a fluid jet cutting system, and wherein selectively deforming the at least one resiliently compressible region of the adjustable tool mount until the tool or the tool indexing member can travel freely axially within the alignment bore of the reference position device includes selectively deforming the at least one resiliently compressible region while the cutting head is operating at high pressure.

27. The method of claim 25 wherein the tool is a cutting head of a fluid jet cutting system, and wherein the method further comprises operating the cutting head at different pressures to verify alignment of a portion of the cutting head with the alignment bore at the different pressures.

28. The method of claim 20 wherein the reference position device comprises two perpendicular dial indicators with reference readings, and wherein guiding the tool or the tool indexing member to interact with the reference position device includes guiding the tool or tool indexing member into engagement with the dial indicators.

29. The method of claim 28 wherein selectively deforming the at least one resiliently compressible region of the adjustable tool mount to comply with the reference position device includes selectively deforming the at least one resiliently compressible region of the adjustable tool mount until the reference readings of the dial indicators do not change when the tool or the tool indexing member travels axially.

30. The method of claim 20 where the reference position device is any type of position measurement instrument.

* * * * *